US007993161B2

(12) United States Patent
Mao et al.

(10) Patent No.: US 7,993,161 B2
(45) Date of Patent: Aug. 9, 2011

(54) LOW PROFILE CONNECTOR WITH COMBO SOLDER TAILS

(75) Inventors: Yu-Hua Mao, Kunshan (CN); Zhi-Hong Fang, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/755,383

(22) Filed: Apr. 6, 2010

(65) Prior Publication Data

US 2011/0086546 A1 Apr. 14, 2011

(30) Foreign Application Priority Data

Oct. 12, 2009 (CN) ..... 2009 2 0312275

(51) Int. Cl.
*H01R 13/648* (2006.01)

(52) U.S. Cl. ..... 439/607.4; 439/79

(58) Field of Classification Search ..... 439/79, 439/607.35–607.4, 607.2, 607.21, 607.23, 439/607.13, 607.26, 607.33
See application file for complete search history.

(56) References Cited

U.S. PATENT DOCUMENTS 6,776,660 B1 8/2004 Kubota et al.
7,625,235 B2 * 12/2009 Wu et al. ..... 439/607.35
7,771,232 B2 * 8/2010 Si et al. ..... 439/607.01
7,785,149 B2 * 8/2010 Kamata et al. ..... 439/607.35
7,837,507 B1 * 11/2010 Yang et al. ..... 439/607.31
7,841,901 B2 * 11/2010 Yu et al. ..... 439/620.01
7,871,297 B2 * 1/2011 Li ..... 439/607.54
2008/0176455 A1 * 7/2008 Fang et al. ..... 439/709
2010/0248543 A1 * 9/2010 Yu et al. ..... 439/607.01

FOREIGN PATENT DOCUMENTS

CN 200720176746.3 9/2008

* cited by examiner

*Primary Examiner* — T C Patel
*Assistant Examiner* — Harshad C Patel
(74) *Attorney, Agent, or Firm* — Andrew C. Cheng; Wei Te Chung; Ming Chieh Chang

(57) ABSTRACT

A low profile connector for mounting on a PCB comprising: an insulative housing, a plurality of terminals, a shielding shell and an auxiliary member. Each terminal is provided with a contacting section and a solder portion extending beyond insulative housing for connecting with the PCB. The shielding shell defines a mating opening surrounding the contact portion, and the auxiliary member defines a main portion attached to a bottom surface of the shielding shell and at least one horizontal portion located at one end thereof for mounting on an upper surface of the PCB. The shielding shell further includes a vertical portion perpendicular to the horizontal portion for inserting a hole of the PCB, and the horizontal portion of the auxiliary member has a concavity for receiving the vertical portion which decreasing space that the connector located on the PCB.

20 Claims, 9 Drawing Sheets

LOW PROFILE CONNECTOR WITH COMBO SOLDER TAILS

BACKGROUND OF THE INVENTION

1. Field of the Invention

The present invention relates to a low profile connector, and more particularly to a low profile connector with a combo solder tails suitably soldered to both via and conductive pad of a Printed Circuit Board (PCB).

2. Description of the Related Art

U.S. Pat. No. 6,776,660 issued to Kubota et al. on Aug. 17, 2004, discloses a conventional electrical connector that includes a housing, a number of contacts retained in the housing and a shell covering the housing. The shell includes a pair of end walls opposite to each other and formed a mating space therebetween, and each end wall has a vertical tail and a horizontal tail substantially perpendicular to the vertical tail and arranged along a mating direction, however, the horizontal tail and the vertical tail are located apart from each other, accordingly, increasing an additional space which the electrical connector located on the PCB, on the other hand, mechanical and electrical connection between the electrical connector and the PCB is unsteady.

Therefore, an improved low profile connector is desired to overcome the disadvantages of the related arts.

BRIEF SUMMARY OF THE INVENTION

An object of the present invention is to provide a low profile connector with decreasing space which the connector located on the PCB.

In order to achieve above-mentioned object, a low profile connector for mounting on a Printed Circuit Board (PCB) comprising: an insulative housing defined a plurality of passageways; a plurality of terminals received in the passageways of the insulative housing. Each terminal is provided with a contacting section for mating with a contact portion of a mating connector and a solder portion extending beyond insulative housing for connecting with the PCB. A shielding shell defines a mating opening surrounding the contact portion for accommodating a mating portion of the mating connector along a mating direction. An auxiliary member defines a main portion attached to a bottom surface of the shielding shell and at least one horizontal portion located at one end thereof for mounting on a conductive pad located on an upper surface of the PCB. The shielding shell further includes a vertical portion perpendicular to the horizontal portion for inserting a via of the PCB, and the horizontal portion of the auxiliary member has a concavity running through a upper surface and a lower surface thereof for receiving the vertical portion which decreasing space that the connector located on the PCB.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
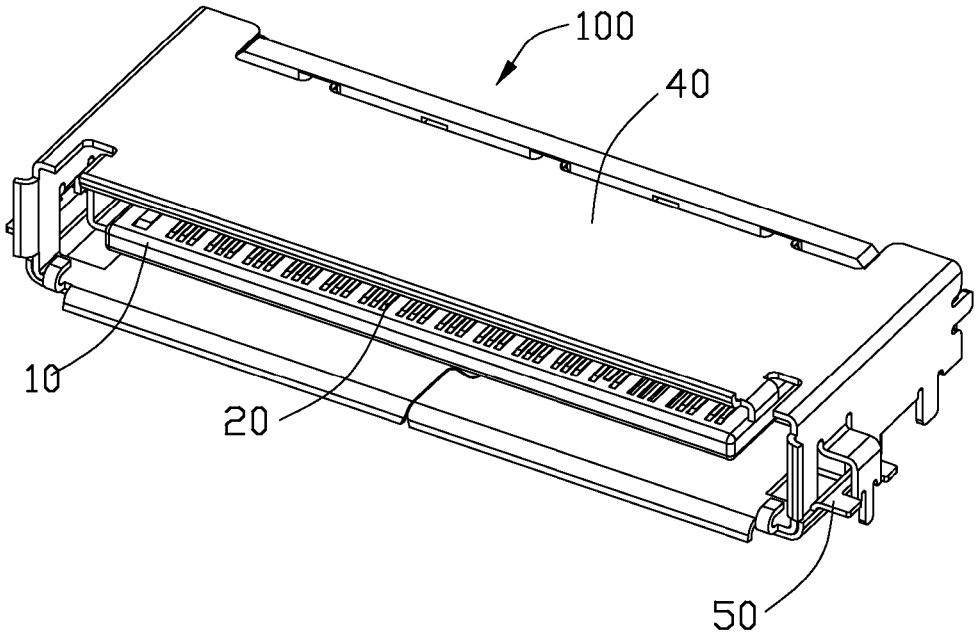
FIG. 1 is a perspective view of a low profile connector in accordance with the present invention.

Reference will now be made to the drawing figures to describe the preferred embodiments of the present invention in detail.

Figure 2:
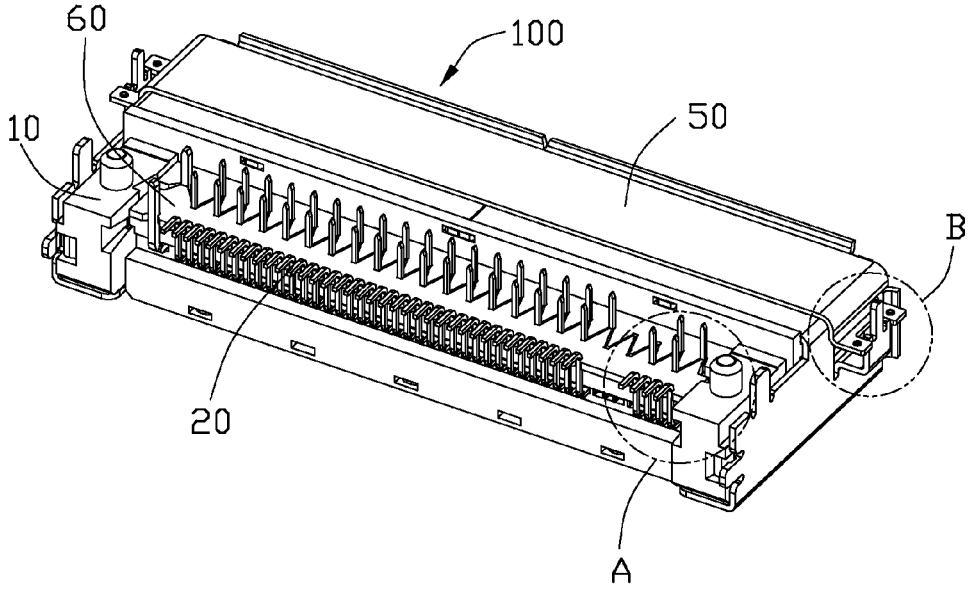
FIG. 2 is another perspective view of FIG. 1.

Referring to FIGS. 1 and 2, a low profile connector 100 made in accordance with the present invention includes an elongated insulative housing 10, a plurality of terminals 20 loaded in the insulative housing 10 along a horizontal direction, a shielding shell 40 covering the insulative housing 10, a spacer 60 mounted on the housing and an auxiliary member 50 attached to a bottom surface of the shielding shell 40, the shielding shell 40 and the auxiliary member 50 are made of conductive material.

Figure 3:
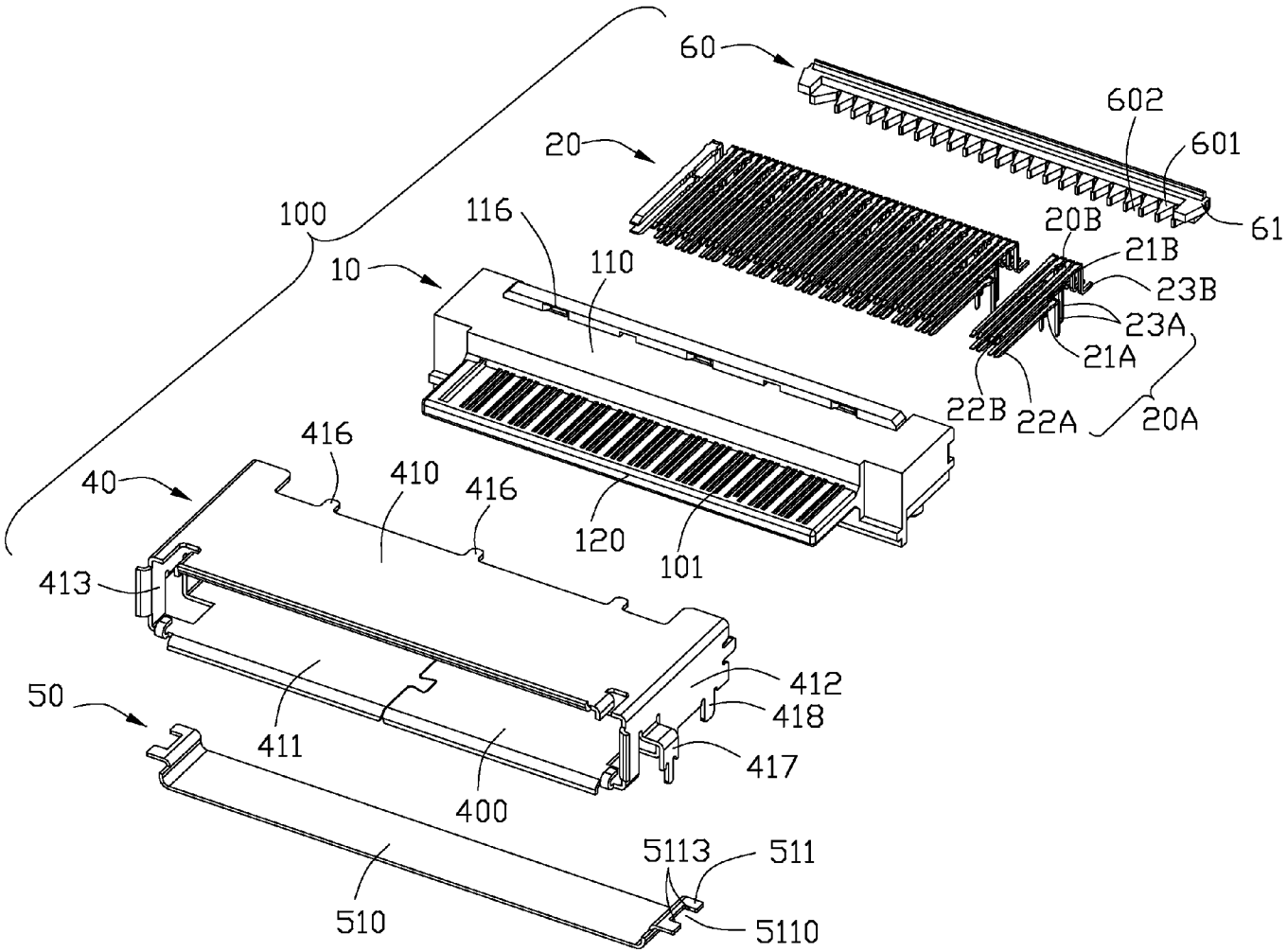
FIG. 3 is an exploded view of the low profile connector shown in FIG. 1.
Figure 4:
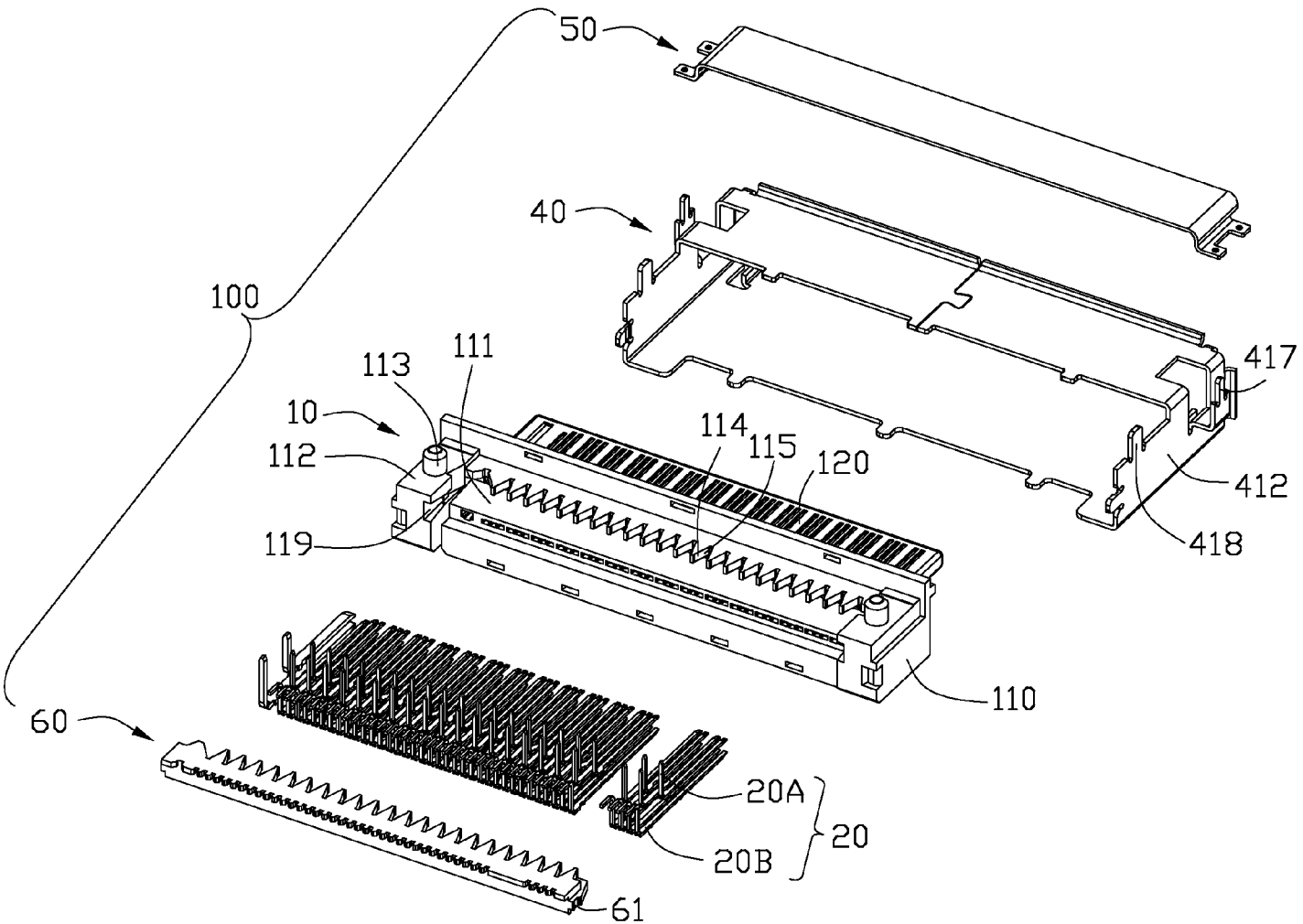
FIG. 4 is an exploded view of the low profile connector shown in FIG. 2.
Figure 7:
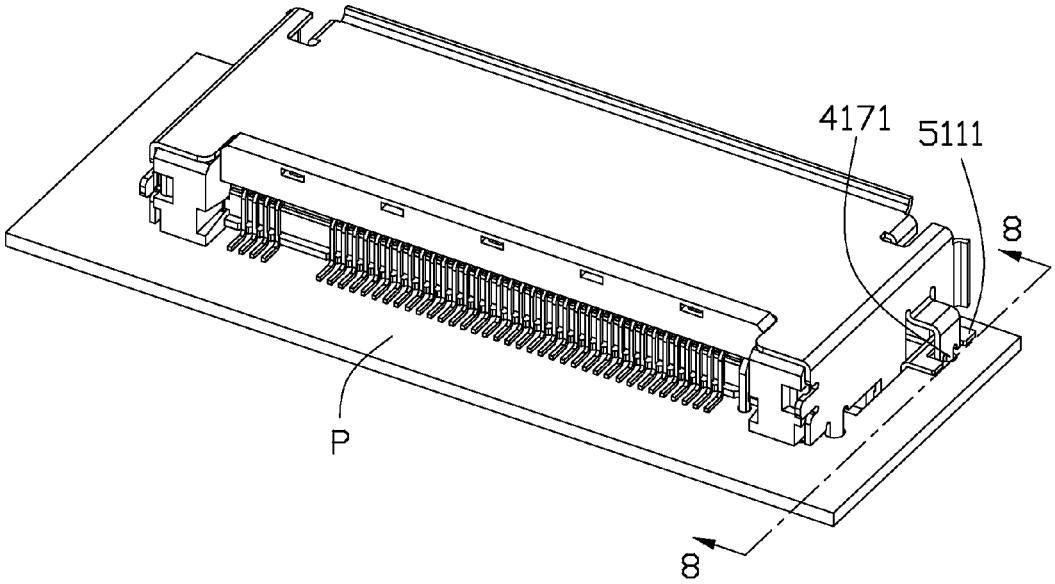
FIG. 7 is similar to FIG. 1, but taken from a rear view; and showing the low profile connector mounted on the Printed Circuit Board (PCB)

Referring to FIGS. 3, 4 and 7, the insulative housing 10 is provided with a base portion 110, a tongue portion 120 extending forwardly from the base portion 110. The base portion 110 has a recessed area 111 at bottom thereof, i.e. in a rear area in this embodiment, thereby a mounting surface 112 for mounting onto the PCB is higher than a bottom of the base portion 110 so as to reduce the height of the connector mounted on the PCB, and a pair of posts 113 are formed on the mounting surface 112 of the base portion to be retained within a pair of corresponding orienting holes defined in the PCB. The tongue portion 120 defines an upper surface and a lower surface opposite to the upper surface, and the housing 10 defines a plurality of passageways 101 for receiving the terminals 20, and each passageway 101 extending along a mating direction perpendicular to the horizontal direction and running through the upper surface and lower surface of the tongue portion 120. A rear of the base portion 110 of the housing 10 is provided with a plurality of first protruding portions 114 and a plurality of first slots 115 is formed between the respective neighboring first protruding portions 114.

In this embodiment, the terminals 20 include a first terminals 20A located on the lower surface of the tongue portion 120 and a second terminals 20B located on the upper surface of the tongue portion 120. Each of the first terminals 20A and second terminals 20B is provided with retaining portion 21A, 21B secured to the base portion 110 of the housing 10, and further includes a contacting section 22A, 22B extending forwardly from one end of the retaining portion 21A, 21B along a corresponding passageways 101 of the tongue portion 120 for mating with a contact portion of a mating connector along the mating direction and a solder portion 23A, 23B extending backward from another end of the retaining portion 21A, 21B beyond the mounting surface 112 (see FIG. 5).

Figure 8:
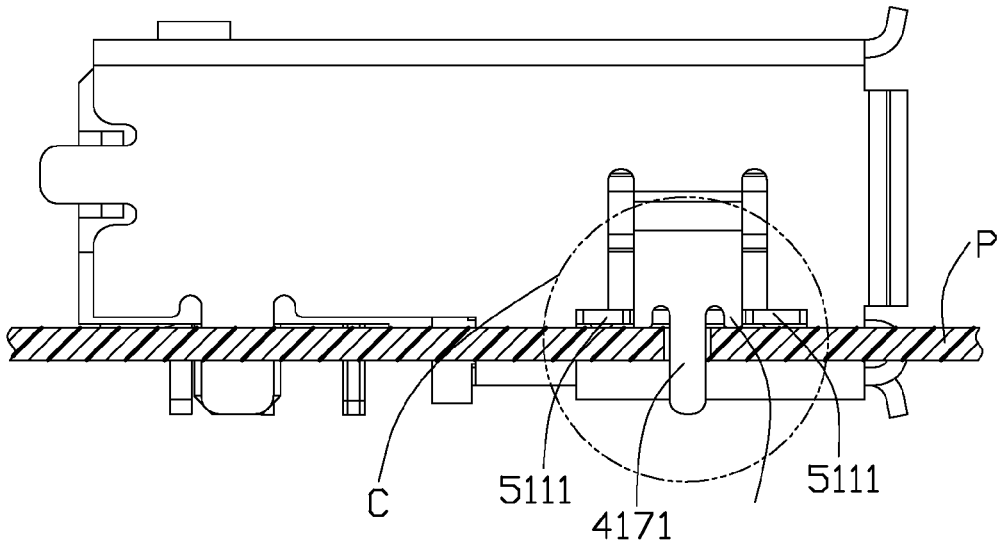
FIG. 8 is a cross-section view taken along a line 8-8 in FIG. 7.
Figure 9:
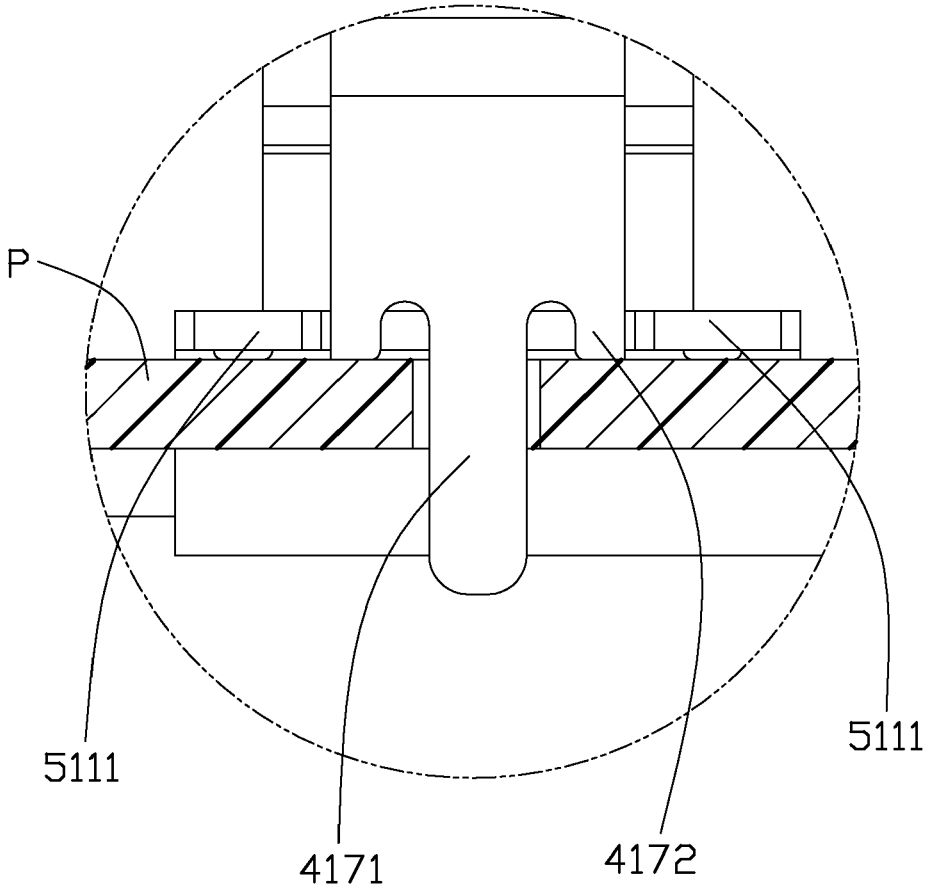
FIG. 9 is an enlarged view of the C portion of FIG. 8.

With referring to FIG. 3 and FIGS. 6 to 9, the shielding shell 40 is assembled on the insulative housing 10 for preventing the low profile connector from EMI (Electro Magnetic Interference). The shielding shell 40 defines an upper sidewall 410, lower sidewall 411 and a pair of endwalls 412, 413 interconnecting with the upper and lower sidewalls 410, 411 thereby forming a mating cavity 400 thereamong. Each of the upper sidewall 410 and the lower sidewall 411 is provided with retaining portions 416 extending backward from thereof for retaining a corresponding receiving holes 116 of the base portion 110, respectively. In this embodiment, each of the endwalls of shielding shell includes a vertical portion 417 extending downward along vertical direction perpendicular to the mating direction and a solder portion 418 parallel with the vertical portion 417 abutting against two ends of the base portion 110, and the vertical portion 417 formed a 7-shape which includes a bending portion 4170 connecting with the endwall of the shell and a vertical tail 4171 connecting and perpendicular to the bending portion 4170, and a distal end of the vertical tail 4171 inserted a via of the PCB P. And the vertical tail 4171 further defines a supporting portion 4172 for supporting the upper surface of the PCB P, as best shown in FIG. 8 or FIG. 9.

Figure 5:
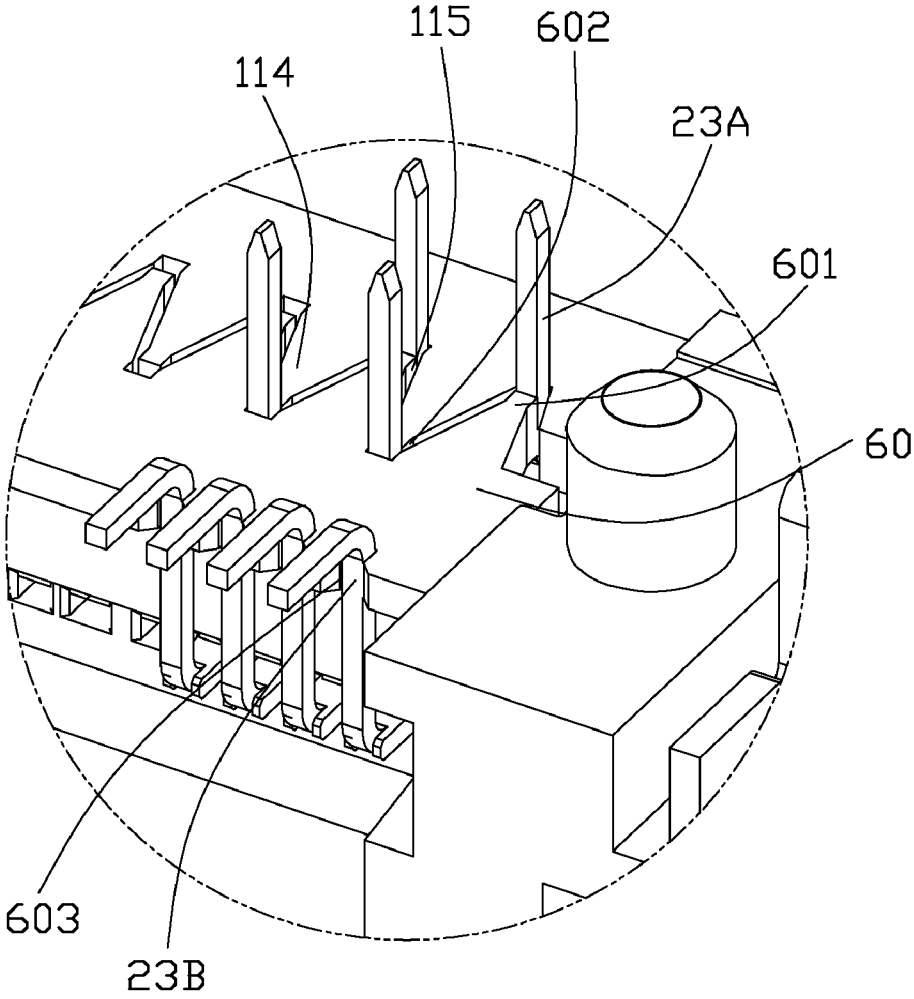
FIG. 5 is an enlarged view of the A portion of FIG. 2.
Figure 6:
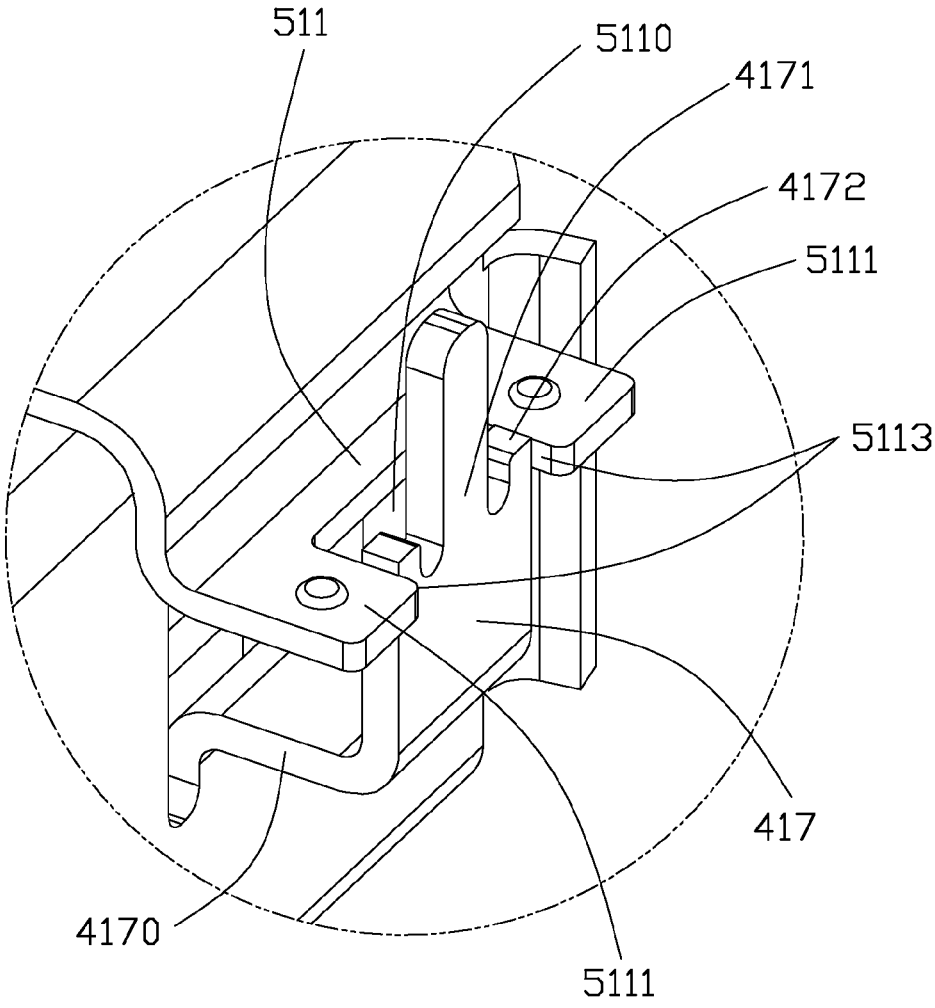
FIG. 6 is an enlarged view of the B portion of FIG. 2.

With referring to FIG. 3 to FIG. 5, the spacer 60 is provided with a plurality of second protruding portion 601 and second slots 602 for mating with corresponding to the first slots 115 and first protruding portion 114 of the housing 10 in the front area, respectively, so a plurality of the solder portions 23A of the first terminals 20A are fitly set between the first protruding portion 114 or slots 115 of the housing 10 and the slots 602 or second protruding portion 602 of the spacer 60, as best shown in FIG. 5. And the spacer 60 further defines a plurality of third slots 603 in a rear area for receiving the solder portions 23B of the second terminals and a pair of lock portion 61 respectively projecting from two ends thereof for receiving a corresponding channel 119 of the base portion 110.

With referring to FIG. 3 and FIGS. 6 to 8 again, the auxiliary member 50 attached to the bottom surface of the shielding shell 40 by spot soldering so as to provide a robust engagement therebetween. The auxiliary member 50 has a main portion 510 attached to a bottom of the lower sidewall of the shielding shell 40 and a pair of horizontal portion 511 extending from two ends of the main portion 510 for mounting onto the upper surface of the PCB P. In this embodiment, the horizontal portion 511 defines a concavity 5110 running through an upper surface and lower surface thereof and formed a pair of solder surfaces 5111 for mounting on a conductive pad of the upper surface of the PCB P, and each solder surface has a pair of opposite side faces 5113, the vertical tail 4171 of the vertical portion 417 of the shell 40 received the concavity 5110 of the horizontal portion 511 and secured sandwiched between two said faces 5113 of the horizontal portion 511, and a distal end of the vertical portion 417 inserted the corresponding via of the PCB and a supporting portion 4172 of vertical portion 417 supported by the upper surface of the PCB P. So with this arrangement, the horizontal portion 5111 and vertical portion 417 can be reliably mounted to the PCB P together and reduced the size of the PCB, on the other hand, the horizontal portion 511 and the vertical portion 417 is perpendicular to each other which improves the solder possibility, and the bending portion 4170 of the shielding shell 40 being vertical apart from the horizontal portion 5111 of the auxiliary member 50 along vertical direction perpendicular to the mating direction, so the bending portion 4170 can prevent the molten solder from flowing the shell 50 along the vertical tail 4171. Of course, the horizontal portion 511 and the vertical portion 417 are formed by an integral metal.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. A low profile connector for mounting on a Printed Circuit Board (PCB), comprising:

an insulative housing defined a plurality of passageways;

a plurality of terminals received in the passageways of the insulative housing, and each is provided with a contacting section for mating with a contact portion of a mating connector and a solder portion extending beyond insulative housing for connecting with the PCB;

a shielding shell provided with a mating opening surrounding the contact portion for accommodating a mating portion of the mating connector along a mating direction;

an auxiliary member defined a main portion attached to a bottom surface of the shielding shell and at least one horizontal portion located at one end thereof for mounting on a upper surface of the PCB;

wherein the shielding shell further includes a vertical portion perpendicular to the horizontal portion for inserting a via of the PCB, and the horizontal portion of the auxiliary member has a concavity running through a upper surface and a lower surface thereof for receiving the vertical portion.

2. The low profile connector as described in claim 1, wherein the concavity of the horizontal portion of the auxiliary member is formed with a pair of side faces towards each other and the vertical portion of the shielding shell is secured sandwiched between two the said faces of the concavity.

3. The low profile connector as described in claim 2, wherein the shielding shell includes an upper sidewall, lower sidewall and a pair of endwalls interconnecting with the upper and lower sidewalls and forming said mating opening thereamong, and the auxiliary member attached to the lower sidewall of the shielding shell.

4. The low profile connector as described in claim 3, wherein the vertical portion is provided with a bending portion connecting with the endwall of the shielding shell and apart from the horizontal portion of the auxiliary member along a vertical direction perpendicular to the mating direction and a vertical tail connecting with the bending portion and received into the concavity of the auxiliary.

5. The low profile connector as described in claim 1, wherein the vertical portion of the shielding shell formed 7-shape which includes a bending portion apart from the horizontal portion of the auxiliary member along a vertical direction and a vertical tail secured the concavity of the horizontal portion.

6. The low profile connector as described in claim 1, wherein the low profile connector further includes a spacer for mounting on the insulative housing along a direction opposite to the mating direction of the connector, and the insulative housing has a plurality of first protruding portions and a plurality of first slots is formed between the respective neighboring first protruding portions, and a plurality of second slots are formed on one side of the spacer corresponding to the protruding portions of the housing and a plurality of third slots are formed on another side of the spacer, and each the solder portion of a first terminal of the terminals are secured between the first protruding portions or the first slots of the housing and the second slots or second protruding portions of the spacer, respectively, and each said solder portion of a second terminal of the terminals are secured in the third slots of the spacer.

7. An electrical connector comprising:

an insulative housing having a tongue portion defined a plurality of passageways;

a plurality of terminals received in the passageways of the insulative housing, and each is provided with a contacting section exposed on the tongue portion and a solder portion extending beyond insulative housing;

a shielding shell defined a mating opening surrounding the tongue portion for accommodating a mating portion of a mating connector along a mating direction;

an auxiliary member attached to a bottom surface of the shielding shell and defines a horizontal portion located at one end of the shielding shell; and the horizontal portion defines a pair of solder surfaces with a pair of opposite side faces;

wherein the vertical portion of the shielding shell is secured sandwiched between two said faces of the solder surfaces of the horizontal portion.

8. The electrical connector as described in claim 7, wherein the shielding shell includes an upper sidewall, lower sidewall and a pair of endwalls interconnecting with the upper and lower sidewalls and forming said mating opening thereamong, and the auxiliary member attached to the lower sidewall of the shielding shell.

9. The electrical connector as described in claim 8, wherein the vertical portion of the shielding shell has a bending portion bending outward respect to the endwall and a vertical tail connecting an end of the bending portion and extending downwardly, and the bending portion of the shielding shell being vertical apart from the horizontal portion of the auxiliary member along a vertical direction perpendicular to the mating direction.

10. The electrical connector as described in claim 7, wherein the vertical portion of the shielding shell formed 7-shape which includes a bending portion apart from the horizontal portion of the auxiliary member along a vertical direction perpendicular to the mating direction and a vertical tail secured the concavity of the horizontal portion.

11. The electrical connector as described in claim 8, wherein the insulative housing has a base portion with a recessed area at a bottom thereof and formed with a mounting surface, the endwall of the shielding shell includes a solder portion and abutting against an outer side of the base portion.

12. The electrical connector as described in claim 11, wherein the upper sidewall of the shielding shell is formed with a retaining portion, and the insulative housing defines a receiving hole for receiving and retaining the retaining portion of the shielding shell.

13. The electrical connector as described in claim 7, wherein the electrical connector further includes a spacer for mounting on the insulative housing along a direction opposite to the mating direction of the connector, and the insulative housing has a plurality of first protruding portions and a plurality of first slots is formed between the respective neighboring first protruding portions, and a plurality of second slots are formed on one side of the spacer corresponding to the protruding portions of the housing and a plurality of third slots are formed on another side of the spacer, and each a solder portion of a first terminal of the terminals are secured between the first protruding portions or the first slots of the housing and the second slots or second protruding portions of the spacer, respectively, and each a solder portion of a second terminal of the terminals are secured in the third slots of the spacer.

14. An electrical connector comprising:

an insulative housing extending along a longitudinal direction and defining a horizontal mating port communicating with an exterior in a front-to-back direction perpendicular to said longitudinal direction;

a plurality of terminals disposed in the housing with contacting sections exposed in the mating port;

a set of metallic shell covering the housing and defining a pair of outwardly extending surface mounting sections on two opposite sides of the housing for mounting to a printed circuit board in a vertical direction perpendicular to said longitudinal direction and said front-to-back direction, each of said surface mounting sections defining a U-shaped configuration having two opposite sides linked by a bight thereof and commonly defining a notch therein, said metallic shell further including a pair of vertical mounting sections each extending downwardly vertically from a position above said surface mounting section into the corresponding notch; wherein the vertical mounting section is spaced from the corresponding bight in said longitudinal direction.

15. The electrical connector as claimed in claim 14, wherein said vertical mounting section is closer to an opening of the corresponding notch than to the corresponding bight in said longitudinal direction.

16. The electrical connector as claimed in claim 14, wherein said vertical mounting section extends from a horizontal section of the shell, which horizontally extends at a level above said surface mounting section in the vertical direction.

17. The electrical connector as claimed in claim 14, wherein said set of metallic shell includes upper and lower pieces, and the surface mounting section extends unitarily from the lower piece and the vertical mounting section extends unitarily from the upper piece.

18. The electrical connector as claimed in claim 17, wherein the vertical mounting section is split from a lower portion of the upper piece.

19. The electrical connector as claimed in claim 17, wherein the upper piece encloses a bottom face of the housing.

20. The electrical connector as claimed in claim 14, wherein said vertical mounting section includes a center vertical tail for extending into a corresponding through hole in the printed circuit board, and a pair of supporting portions by two sides of the center vertical tail for being seated upon the printed circuit board.

* * * * *